US005198610A

United States Patent [19]

Kennedy et al.

[11] Patent Number: 5,198,610

[45] Date of Patent: Mar. 30, 1993

[54] SYSTEM AND METHOD FOR QUENCHING A FIRING CONDITION

[75] Inventors: Robert E. Kennedy, Los Gatos; Emil F. Klinke, Fremont, both of Calif.

[73] Assignee: Westinghouse Electric Corp., Pittsburgh, Pa.

[21] Appl. No.: 874,943

[22] Filed: Apr. 28, 1992

[51] Int. Cl.[5] ..... F41F 3/04

[52] U.S. Cl. ..... 89/1.812; 89/1.81; 89/1.816

[58] Field of Search ..... 89/1.812, 1.81, 1.809, 89/1.816, 1.818, 1.8

[56] References Cited

U.S. PATENT DOCUMENTS

| | | | |
|---|---|---|---|
| 1,264,390 | 5/1918 | Hamilton . | |
| 2,560,269 | 7/1951 | Berner | 169/2 |
| 3,052,303 | 9/1962 | Lapp | 89/1.812 |
| 3,183,904 | 5/1965 | Barakauskas | 89/1.81 |
| 3,298,278 | 1/1967 | Barakauskas | 89/1.81 |
| 3,320,742 | 5/1967 | Troax | 89/1.8 |
| 3,703,930 | 11/1972 | Lofstrand et al. | 89/1.812 |
| 4,397,215 | 8/1983 | Stroud | 89/1.816 |
| 4,436,016 | 3/1984 | Olmsted et al. | 89/1.818 |

*Primary Examiner*—David H. Brown
*Attorney, Agent, or Firm*—D. Schron

[57] ABSTRACT

A system and method for suppressing heat around a missile housed in a canister during a restrained firing condition is provided. A missile canister has a hollow wall and an inner side provided with a plurality of dispensing holes. A coolant reservoir communicates with the canister wall via a coolant intake port. When a restrained firing condition occurs, gas is generated below the missile while the missile is physically restrained within the canister. The gas pressure impinges on a flexible face of the coolant reservoir causing its volume to decrease and coolant to be urged into the canister wall and out of the dispensing holes.

14 Claims, 6 Drawing Sheets

SYSTEM AND METHOD FOR QUENCHING A FIRING CONDITION

FIELD OF THE INVENTION

The present invention relates to missile launching systems. In particular, the invention involves heat suppression around a missile warhead during a restrained firing condition.

BACKGROUND OF THE INVENTION

Missiles are typically housed in canisters in a ready firing state. Such a missile can be launched out of the canister by initiation of its own booster propellant or separate gas generation below the missile and release of a physical restraint mechanism. Although uncommon, it is possible to inadvertently cause activation of the launch element without release of the physical restraint mechanism. It is the function of the restraint system to prevent inadvertent launch of the missile under all conditions other than a legitimate launch signal (e.g., in port, training maneuvers, proximity of friendly or neutral forces). This situation is referred to as a "restrained firing condition". In a restrained firing condition, a large amount of heat is generated around the warhead while the missile remains in the canister. If the temperature around the warhead becomes too hot, for example above 600° F., the warhead may explode causing accidental catastrophic injury to lives and structures in the vicinity of the missile canister.

For example, vertical launch system (VLS) missiles are often located internally on naval ships. Accidental explosion of a naval VLS missile could cause loss of an entire ship along with its passengers and crew.

Therefore, it is essential that missile launch systems be provided with a device and process for preventing missile explosion in a restrained firing condition. Such a system is referred to as a "quench system". The existing system for combating the type of catastrophic event previously described is to introduce water from the ships firefighting main system into the affected canister. Although such a system is useful for final containment and extinguishment, there are problems with dependance on this system alone.

First, the firefighting system operates ship wide and is not specific for the launch module area. As such it is subject to delays incurred by functional constraints and system initiation.

Second, in the pursuit of increased firepower utilizing existing assets, concepts of weapon densities as much as 400% greater in the same space have been developed. This increase of ordinance per volume creates problems for the conventional system both in penetration of the system into each canister and efficiency in quenching specific critical areas.

Third, the catastrophic potential of the increased ordinance makes timely, efficient temperature reduction in critical areas extremely important.

SUMMARY OF THE INVENTION

The problems described above are solved by the device and method of the present invention which involves a system for suppressing heat around a missile housed in a canister during a restrained firing condition. The system employs a missile canister including a hollow wall having an inner side provided with a plurality of dispensing holes, and a coolant intake port. A coolant reservoir communicates with the canister wall via the coolant intake port. A gas generator is provided for pressurizing the coolant reservoir during a restrained firing condition so that coolant contained in the coolant reservoir is urged into the canister wall and out of the dispensing holes.

The present invention also provides a method of suppressing heat around a missile housed in a canister during a restrained firing condition. First, a missile canister having a hollow wall is provided. The hollow canister wall has an inner side provided with a plurality of dispensing holes, and a coolant intake port. A coolant reservoir communicates with the canister wall via the coolant intake port. In response to a restrained firing condition, coolant is urged from the coolant reservoir into the canister wall. The coolant is ultimately dispensed through the dispensing holes into the canister interior, thus quenching the heat produced by the restrained firing condition.

DETAILED DESCRIPTION OF THE PREFERRED EMBODIMENTS

The present invention provides a system and method for suppressing heat around a missile housed in a canister during a restrained firing condition. Missiles, for example, those used in vertical launch systems (VLS), are typically anchored within a canister by a physical restraint device, such as removable clamps or pyrotechnic bolts. Under normal launch conditions, the missile is designed to be propelled out of the canister by the pressure which is generated underneath the missile. A restrained firing condition occurs when the gas generator is activated without releasing the physical restraint device. Under these circumstances, the present invention is designed to utilize the substantial gas pressure generated in a restrained firing condition, to force coolant from a reservoir into a hollow missile canister wall. The coolant is then dispensed through holes which are specially designed to inject or spray the coolant over and against hot gases and surfaces, thereby suppressing heat and preventing accidental missile explosion.

Figure 1:
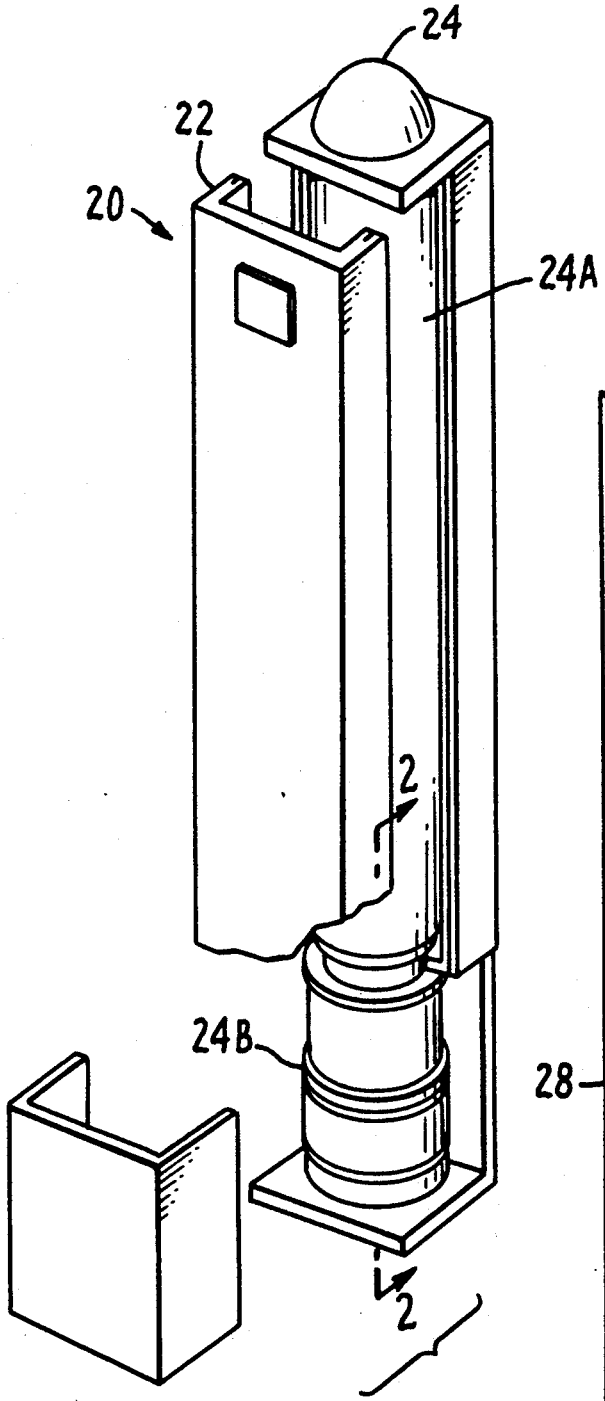
FIG. 1 is an exploded perspective view of a missile housed in a missile canister in a first embodiment of the present invention.

FIGS. 1-9 illustrate a first embodiment of the present invention. FIG. 1 shows a missile canister 20 having a wall 22 substantially surrounding a missile 24. The missile 24 usually contains an explosive warhead near its upper portion 24A and a propellant device in a lower portion 24B.

Figure 2:
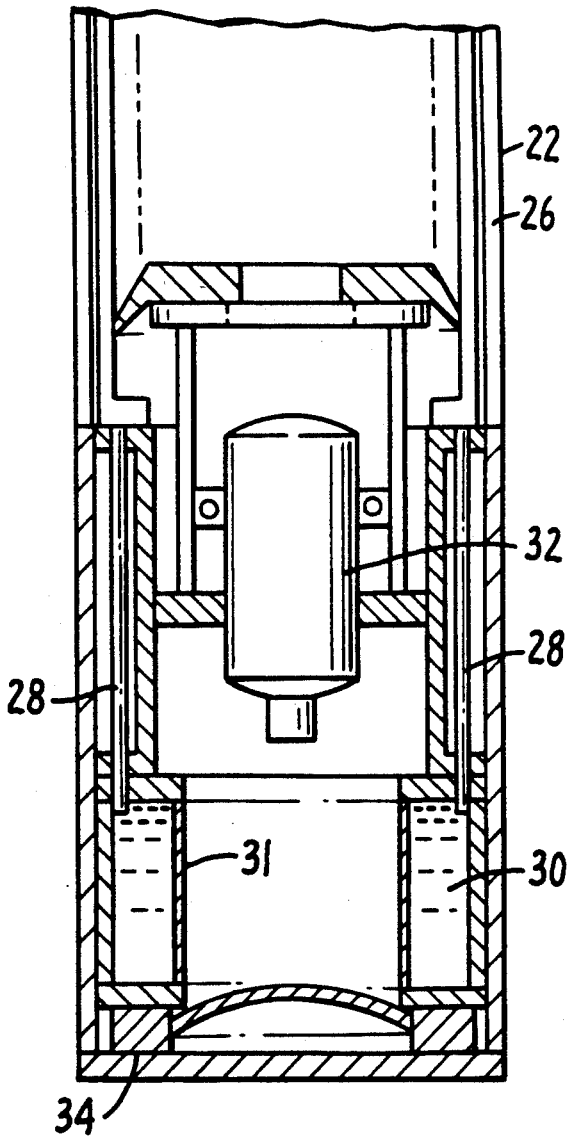
FIG. 2 is a partial sectional view of a quenching system in the first embodiment of the present invention.

The lower portion of the missile 24 and the canister 20 are shown in more detail in FIG. 2. The canister wall 22 has a hollow section 26 which communicates with pipes 28. The coolant intake pipes 28 receive and transport coolant from coolant reservoir 30 into the hollow section 26 of the canister 22. The coolant reservoir 30 has a flexible face 31. When a gas generator 32 is activated to produce pressure impinging upon the coolant reservoir face 31, the coolant reservoir volume decreases, urging coolant through the coolant intake pipes 28 into the hollow portion 26 of the canister wall 22.

Figure 3:
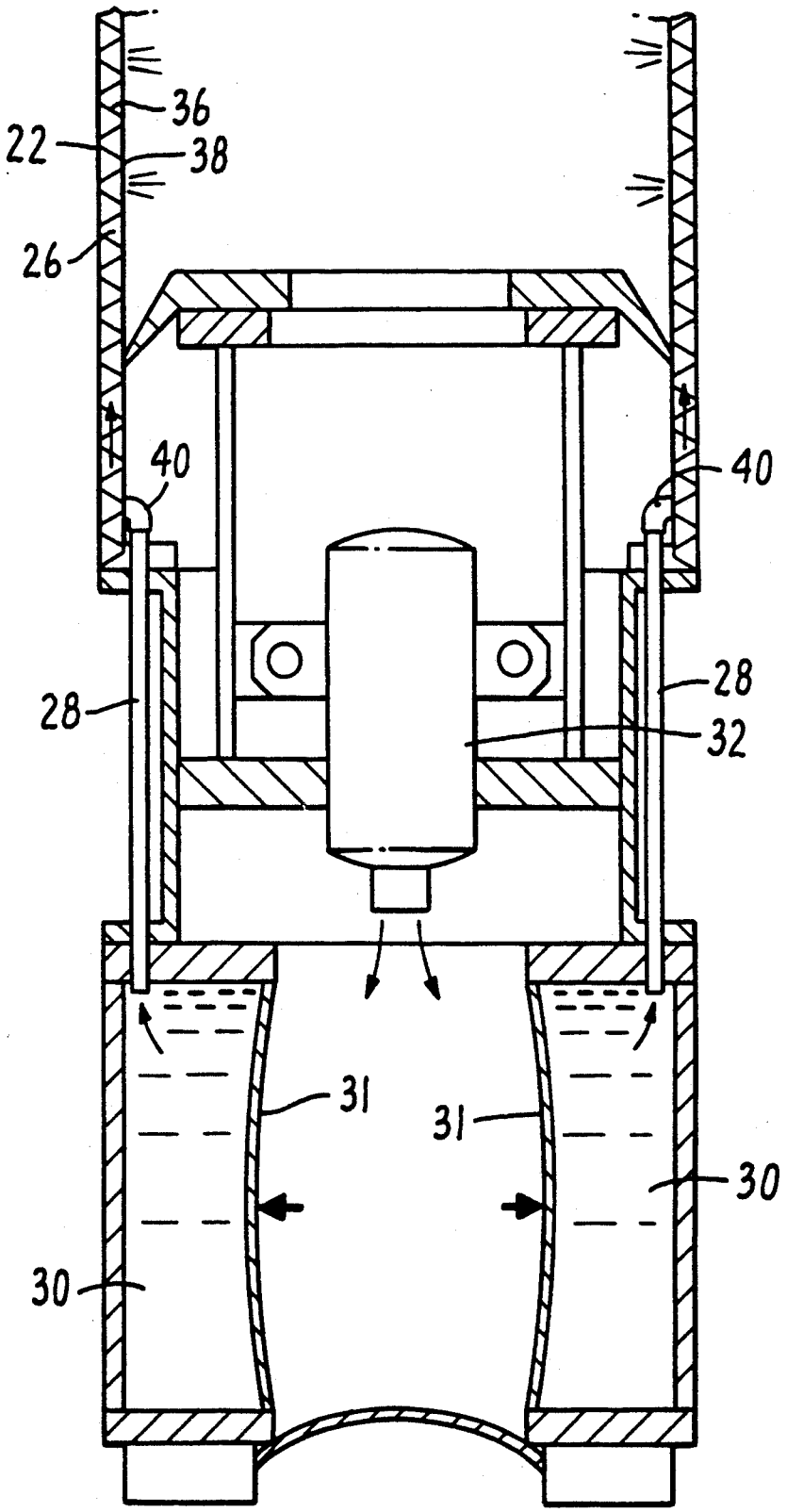
FIG. 3 is a partial sectional view of an activated quench system in the first embodiment of the present invention.

In FIG. 3 gas generated by the gas generator 32 impinges on the coolant reservoir flexible face 31, decreasing the coolant reservoir volume. Note that under normal firing conditions, since the physical restraint device 34 would release, gas generated by the gas generator propels the missile out of the canister without causing significant compression of the coolant reservoir 30.

The coolant reservoir 30, i.e., the coolant receptacle or storage container, may be made in a variety of shapes and sizes depending upon the particular missile system and its storage conditions. In the first embodiment, as shown in FIGS. 1-3, the coolant receptacle 30 is a tire-shaped receptacle having a movable interface 31. However, those skilled in the art will appreciate that the receptacle could be disc-shaped or box-shaped etc., provided that it has a flexible face against which the generated gas impinges, and a connection to a coolant passage 28 for translating coolant into the hollow canister wall 22.

The canister wall 22 is designed to be structurally strong, lightweight, and to allow coolant to pass through its hollow portion 26. In a preferred embodiment the canister wall 22 contains a V-shaped webbing 36 which provides structural support for the wall. The webbing 36 also has holes for allowing coolant to flow. The coolant wall 22 has an inner side 38 provided with holes for dispensing coolant during a restrained firing condition. The coolant wall 22 also has coolant intake ports 40 for receiving coolant from the coolant reservoir 30 through pipes 28.

Figure 4:
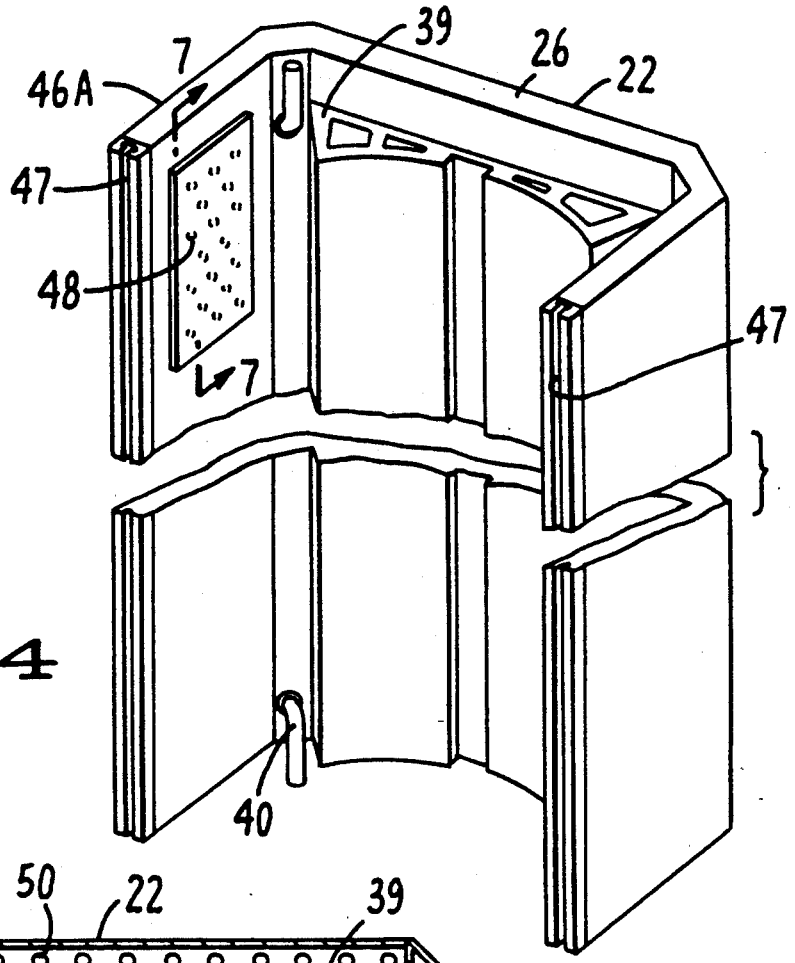
FIG. 4 is a partial perspective view of the canister wall in the first embodiment of the present invention.

In a preferred embodiment, the missile canister 22 is comprised of two U-shaped sections, one of which is shown in FIG. 4. U-shaped section 46A has grooves 47 for joining another U-shaped canister section to form the entire canister wall. The canister wall 22 is provided with coolant dispensing walls 48 on its inner side 38. A lightweight spacer material 39 is provided along one wall of the u-shaped canister section for holding the cylindrical missile in the rectangular canister.

Figure 5:
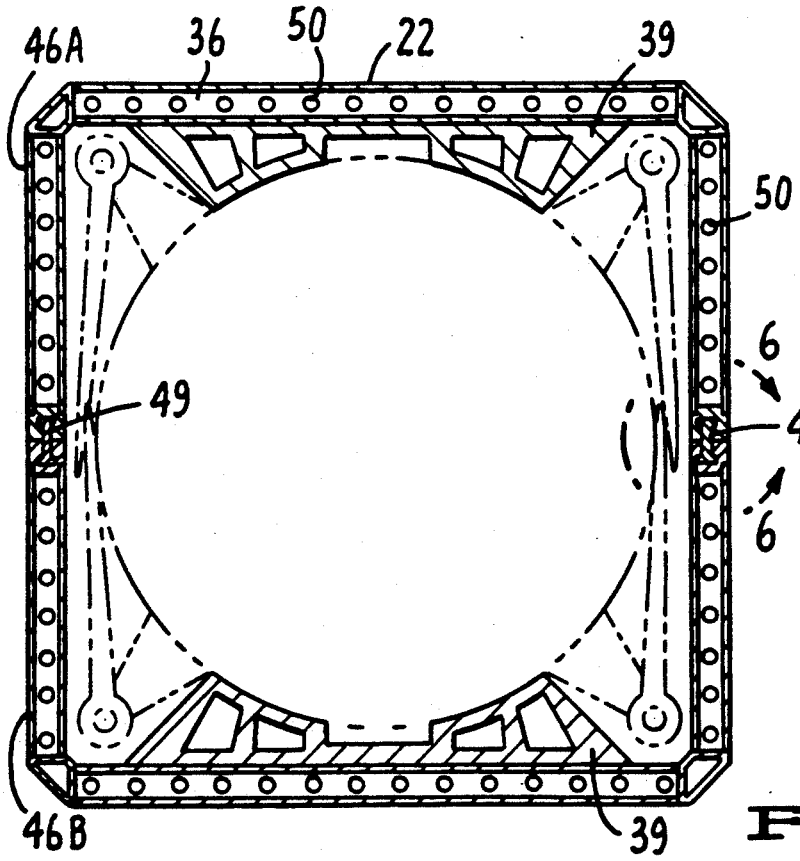
FIG. 5 is a sectional view of the canister wall in a first embodiment of the present invention.
Figure 6:
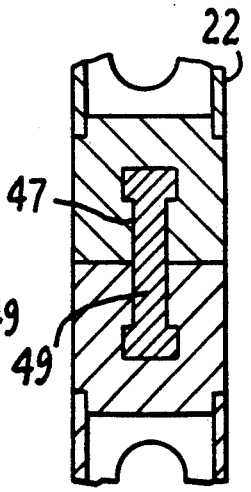
FIG. 6 is a partial sectional view of the pin and wall joint in the first embodiment of the present invention.

FIG. 5 shows a sectional view of the missile canister 22 in a preferred embodiment of the present invention. Canister U-shaped sections 46A and 46B are joined by pins 49. Webbing material 36 has holes 50 for allowing coolant to flow vertically through the canister wall 22. Such a wall material is commercially available from TRE Corporation under the tradename Navsteel TM. FIG. 6 shows a joint between two canister U-shaped sections secured by pin 49 which is dimensioned to fit in groove 47.

Figure 7:
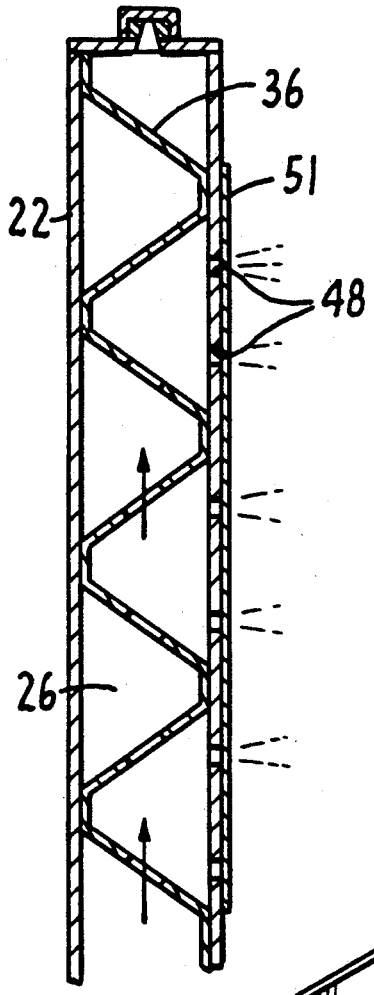
FIG. 7 is a partial sectional view of a canister wall containing webbing for structural support in the first embodiment of the present invention.

When a restrained firing condition occurs, coolant flows as shown in FIG. 7, through the webbing material 36 contained within the hollow portion 26 of the canister wall 22. The coolant is then sprayed out of the coolant dispensing holes 48 to the desired location inside the canister.

A variety of coolant materials may be employed in the present invention. The coolant is preferably a liquid or gel material which is specifically formulated to suppress heat and/or prevent combustion.

Figure 8:
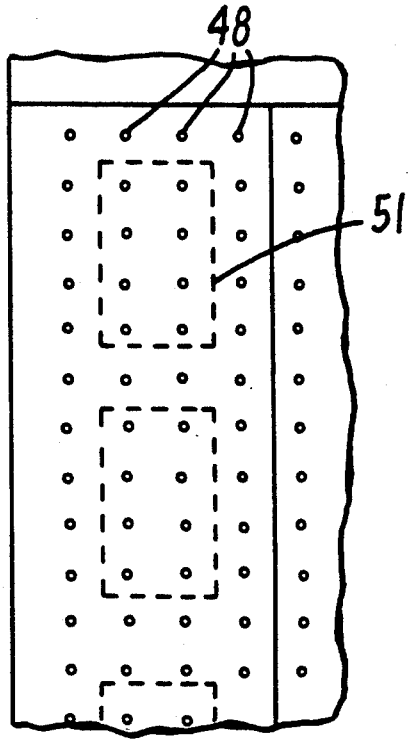
FIG. 8 is a partial view of the inner side of the missile canister wall showing the coolant dispensing holes in the first embodiment of the present invention.
Figure 9:
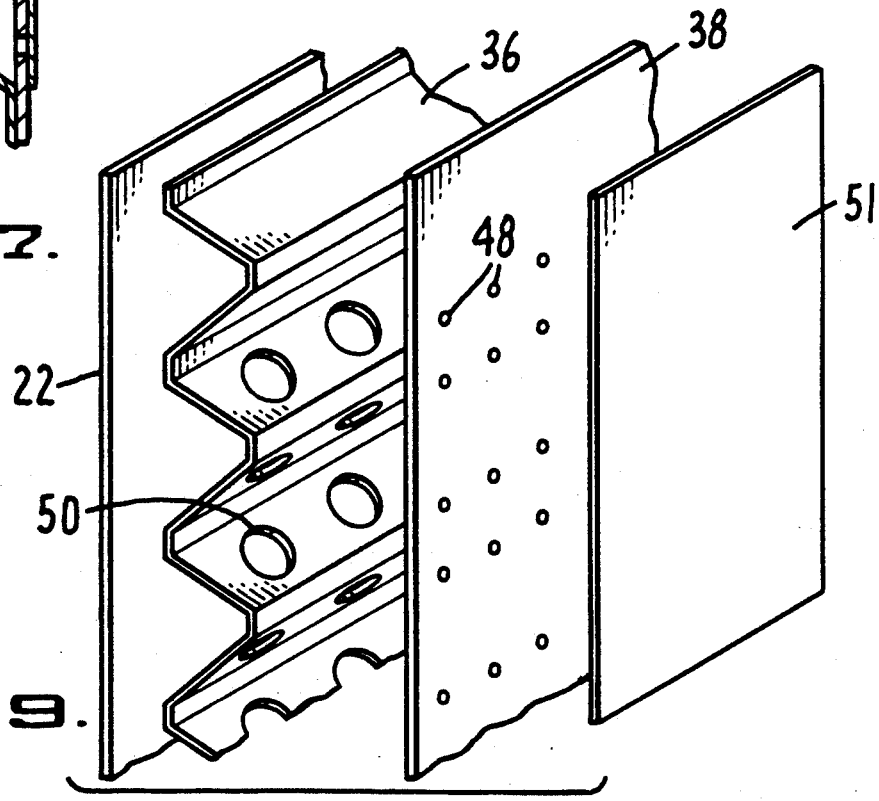
FIG. 9 is partial exploded view of a canister wall in the first embodiment of the present invention.

In a preferred embodiment, as shown in FIG. 8, a film barrier 51 is provided over some or all of the dispensing holes 48 to prevent coolant ejection when the quenching system is not in use. The film barrier 51 may be temperature sensitive or pressure sensitive so as to allow coolant dispensing during a restrained firing condition. It is possible to avoid use of a film barrier 51 over the dispensing holes 48 by employing a coolant having a relatively high surface tension, and relatively small dispensing holes 48. The organization of the canister wall and film barrier materials shown in FIGS. 7 and 8, is illustrated in FIG. 9. The webbing material 36 has holes 50 for allowing coolant to flow through the canister wall 22. The inner side 38 of the canister wall 22 has dispensing holes 48. Film barrier 51 covers all or a portion of the dispensing holes 48.

It is generally preferred that the dispensing hole configuration be designed to produce a spray of coolant particles such that a large surface of the coolant is exposed to hot gases and material surfaces within the canister. The rate of coolant evaporation is a function of the temperature and the amount of coolant surface area exposed to the heat. Thus, it is desireable to break the coolant into many small particles of but a few hundredths of an inch in diameter so that the coolant is rapidly evaporated, thereby maximizing cooling efficiency.

For example, small particle spray is produced by forcing the coolant through a relatively large number of small holes of the order of 0.10 inches in diameter, as contrasted to holes of 0.75 inches or more in diameter. The desired small particles can also be produced through holes of 0.25 inches and over in diameter by installing one or more propeller blades in the hole openings. The rotation of the blades due to flow of the coolant breaks up the coolant into an effective fine particle spray.

A variety of different dispensing hole configurations can be employed to provide the desired coolant distribution inside the canister. For example, in the first embodiment, shown in FIG. 7, the coolant dispensing holes 48 are cut substantially perpendicularly to the plane of the inner side of the canister wall 22. Thus, the coolant is projected along a path which is substantially perpendicular to the canister wall 22.

Figure 10:
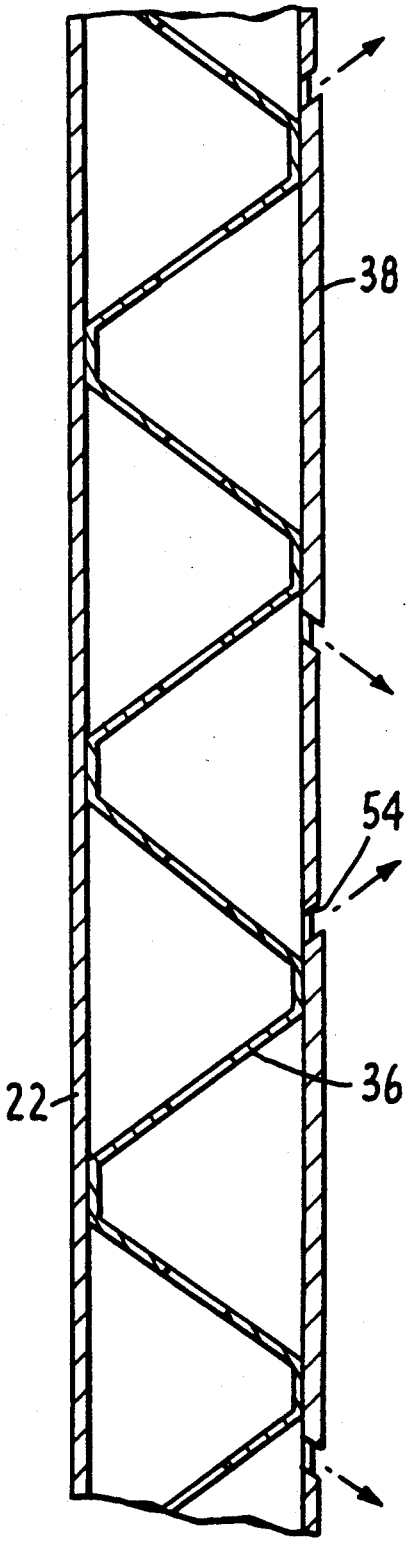
FIG. 10 is a partial sectional view of a canister wall in a second embodiment of the present invention.

In contrast, a second embodiment of the invention, as shown in FIG. 10, has coolant dispensing holes 54 which are obliquely cut through the inner side 38 of the canister wall 22. In the second embodiment the angular dispensing hole configuration allows coolant to be dispensed to specific locations within the canister.

Figure 11:
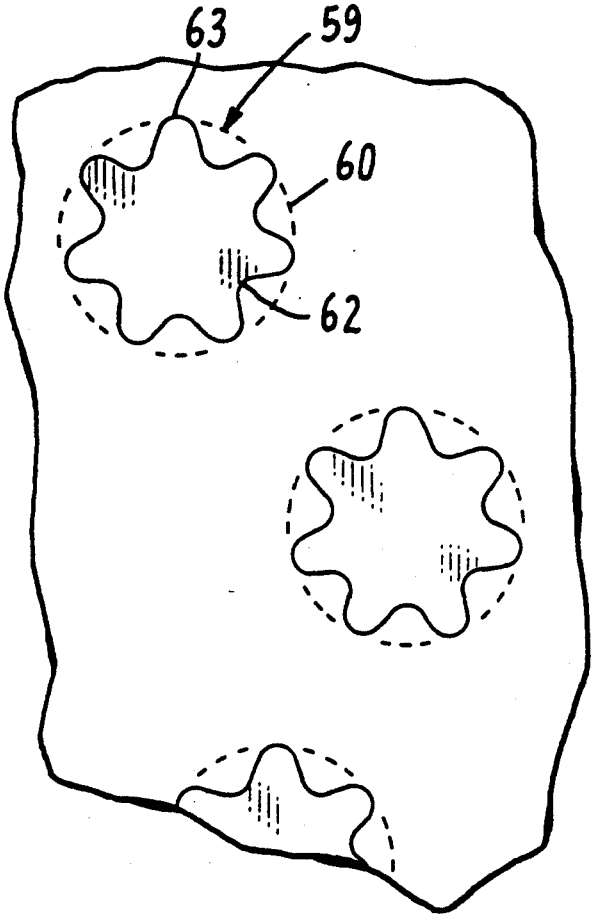
FIG. 11 is a partial view of an inner side of the canister wall having rosette shaped coolant dispensing holes in a third embodiment of the present invention.
Figure 12:
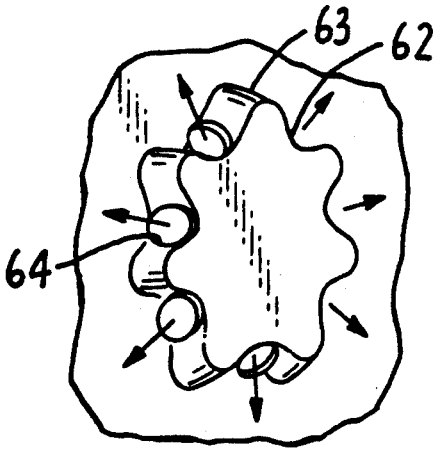
FIG. 12 is a perspective view of a rosette shaped coolant dispensing hole in the third embodiment of the present invention.

FIGS. 11 and 12 illustrate a "rosette" coolant dispensing hole configuration in a third embodiment of the present invention. In the rosette coolant dispensing hole 59 a circular score is made on the inner side 38 of the canister wall 22. The score is sufficient to weaken the inner wall so that it releases under the pressure generated during a restrained firing condition. A rosette-shaped sheet 62 is fixed over the circular score lines 60. The ends of the rosette pinnacles 63 are attached to the canister wall outside of the circular score line 60 so that when the wall releases along the scored line the rosette sheet 62 remains attached over the dispensing hole 59. The result obtained with this design is a plurality of small openings 64 designed to obliquely project coolant away from the center of the rosette-shaped coolant dispensing hole 59. Thus, a coolant spray is produced by the activated rosette dispensing hole configuration, as shown in FIG. 12.

Figure 13:
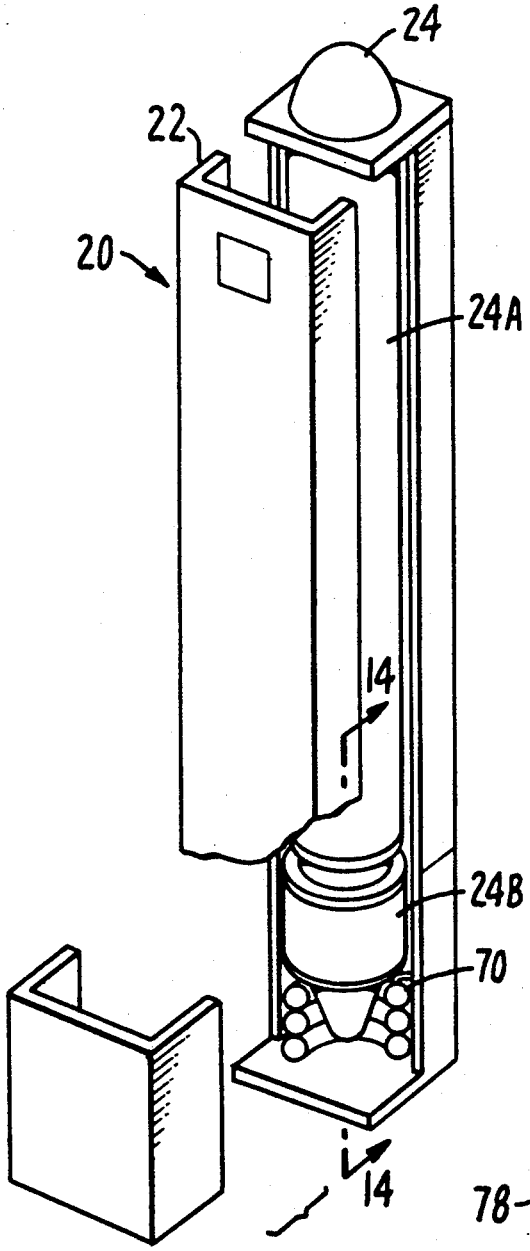
FIG. 13 is an exploded view of a missile housed in a missile canister in a fourth embodiment of the present invention.
Figure 14:
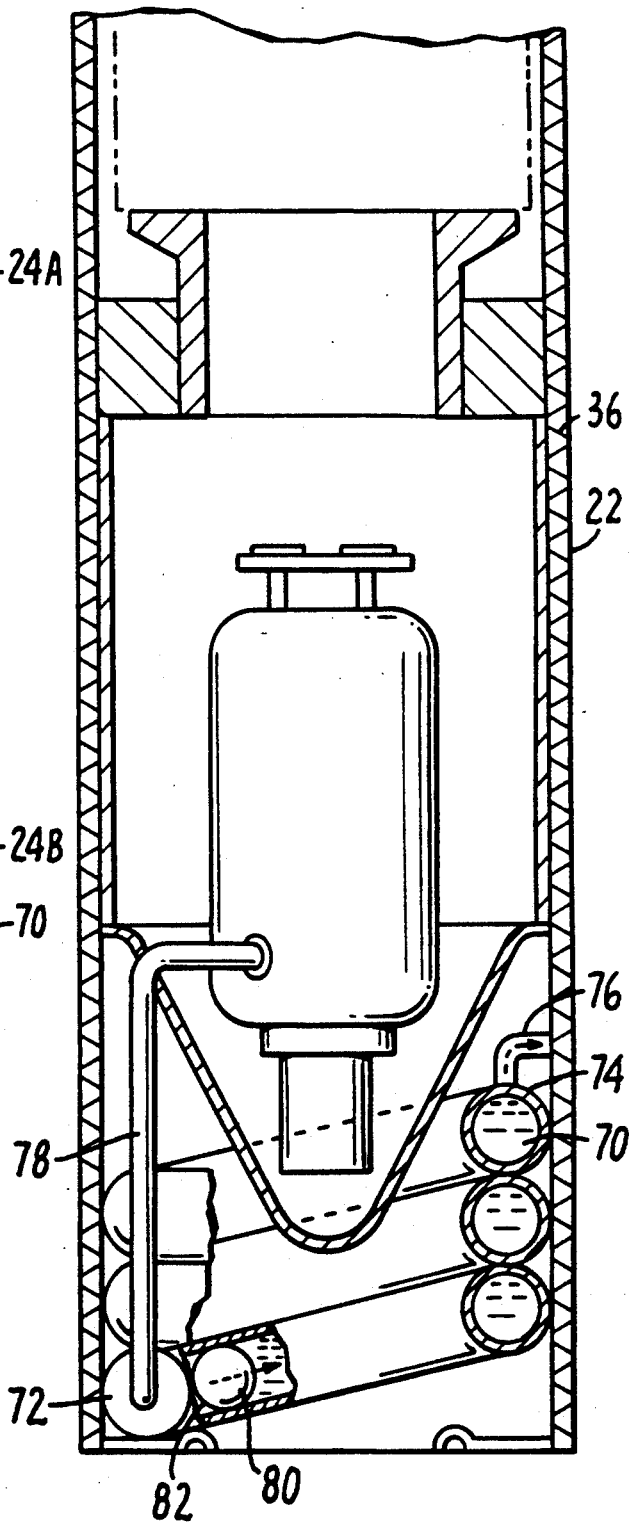
FIG. 14 is a partial sectional view of the quench system in the fourth embodiment of the present invention.

In a fourth embodiment of the present invention, as shown in FIGS. 13 and 14, the coolant reservoir is a helical coil 70. The top end 74 of the coil 70 communicates via a coolant intake passage 76 into the hollow canister wall 22. The bottom end 72 of the coil 70 is connected via pipe 78 to the gas generator 32. A ball piston 80 has a moveable face 82 against which gas generated by the gas generator in a restrained firing condition impinges, urging coolant through the coil 70 and into the canister wall 22.

The claimed invention is not intended to be limited to the specific details of the preferred embodiments described above. Other variations which are readily apparent to those skilled in the art are also claimed.

What is claimed is:

1. A system for suppressing heat around a missile housed in a canister during a restrained firing condition comprising:

a missile canister including a hollow wall having an inner side provided with a plurality of dispensing holes, and a coolant intake port;

a coolant reservoir communicating with said canister wall via said coolant intake port; and means for pressurizing the coolant reservoir during a restrained firing condition so that coolant contained in the coolant reservoir is urged into the canister wall and out of said dispensing holes.

2. The system of claim 1 wherein the pressurizing means is disposed below the missile and has the dual functions of launching the missile under normal firing conditions and activating the quenching system during a restrained firing condition.

3. The system of claim 1 wherein the coolant reservoir is contained within said canister.

4. The system of claim 1 wherein the coolant reservoir is a helical coil.

5. The system of claim 1 further comprising a rigid webbing contained inside the canister wall for providing structural support, the webbing having holes for allowing coolant to flow through the canister wall.

6. The system of claim 1 wherein the dispensing holes are covered by a rosette-shaped sheet so that upon activation of the system, a plurality of openings are produced to project a coolant spray within the missile canister.

7. The system of claim 1 wherein the pressurizing means includes a gas generator, the coolant reservoir having a moveable face which translates to decrease the reservoir volume in response to gas production, thereby urging coolant into the canister wall.

8. The system of claim 7 wherein the gas produced from the gas generator impinges directly on said moveable face of said coolant reservoir.

9. The system of claim 1 further comprising releasable barrier means for covering at least some of the canister dispensing holes.

10. The system of claim 9 wherein said barrier means is a temperature sensitive film.

11. The system of claim 10 wherein said barrier means is a pressure sensitive film.

12. A system for suppressing heat around a missile housed in a canister during a restrained firing condition comprising:

a missile canister including a hollow wall having an inner side provided with a plurality of dispensing holes, and a coolant intake port, the canister wall being structurally strengthened by a rigid webbing contained therein, the webbing having holes for allowing coolant to flow through the canister wall;

a coolant reservoir communicating with said canister wall via said coolant intake port, wherein the coolant reservoir is fully contained within said canister;

a gas generator, the coolant reservoir having a moveable face which translates to decrease the reservoir volume in response to gas production, so that coolant contained in the coolant reservoir is urged into the canister wall and out of said dispensing holes; and wherein said gas generator is disposed below the missile and has the dual functions of launching the missile under normal firing conditions and activating the quenching system during a restrained firing condition.

13. A method of suppressing heat around a missile housed in a canister during a restrained firing condition comprising the steps of:

providing a missile canister including a hollow wall having an inner side provided with a plurality of dispensing holes, a coolant intake port, and a coolant reservoir communicating with said canister wall via said coolant intake port;

urging coolant from said coolant reservoir into said canister wall and dispensing coolant through said dispensing holes into the canister interior in response to a restrained firing condition.

14. The method of claim 13 wherein the coolant reservoir has a moveable face, said urging step including the steps of generating gas, and translating said reservoir face to decrease the reservoir volume in response to gas production.

* * * * *